US008179048B2

(12) United States Patent
Dayton, Jr. et al.

(10) Patent No.: US 8,179,048 B2
(45) Date of Patent: May 15, 2012

(54) HIGH FREQUENCY HELICAL AMPLIFIER AND OSCILLATOR

(75) Inventors: James A. Dayton, Jr., Cleveland, OH (US); Carol L. Kory, Westlake, OH (US)

(73) Assignee: Teraphysics Corporation, Highland Hts., OH (US)

( * ) Notice: Subject to any disclaimer, the term of this patent is extended or adjusted under 35 U.S.C. 154(b) by 767 days.

(21) Appl. No.: 12/035,088

(22) Filed: Feb. 21, 2008

(65) Prior Publication Data

US 2008/0272698 A1 Nov. 6, 2008

Related U.S. Application Data

(60) Provisional application No. 60/902,537, filed on Feb. 21, 2007.

(51) Int. Cl.
*H01J 25/34* (2006.01)

(52) U.S. Cl. ..... 315/39.3; 315/39.53; 315/3.5; 315/5.28; 315/39; 330/43; 330/44; 331/82

(58) Field of Classification Search ..... 315/3.5, 315/3.6, 5.28, 5.34, 5.38, 39, 39.3, 39.53, 315/39.57; 331/81, 82; 330/43–45; 333/156, 333/157

See application file for complete search history.

(56) References Cited

U.S. PATENT DOCUMENTS

| | | | | |
|---|---|---|---|---|
| 3,237,285 | A * | 3/1966 | Gormley et al. | 445/49 |
| 3,309,556 | A | 3/1967 | Lien | |
| 3,336,496 | A * | 8/1967 | Blinn | 315/3.6 |
| 3,617,798 | A | 11/1971 | Marchese et al. | |
| 3,668,544 | A * | 6/1972 | Lien | 330/43 |
| 4,138,625 | A | 2/1979 | Koyama et al. | |
| 4,370,596 | A * | 1/1983 | Winsor | 315/3.6 |
| 4,564,787 | A * | 1/1986 | Kosmahl | 315/3.6 |
| 5,231,330 | A * | 7/1993 | Karsten | 315/3.5 |
| 5,668,442 | A | 9/1997 | Goebel et al. | |
| 6,584,675 | B1 | 7/2003 | Rajan et al. | |
| 6,917,162 | B2 | 7/2005 | Dayton, Jr. | |
| 7,037,370 | B2 | 5/2006 | Mearini et al. | |
| 7,183,716 | B2 * | 2/2007 | Kanarov et al. | 315/111.51 |
| 7,679,462 | B2 * | 3/2010 | Dayton | 331/81 |

FOREIGN PATENT DOCUMENTS

FR 2 884 963 10/2006

OTHER PUBLICATIONS

C. L. Kory and J. A. Dayton, Jr., "Accurate Cold-Test Model of Helical TWT Slow-Wave Circuits," IEEE Trans. ED, vol. 45, No. 4, pp. 966-971 (Apr. 1998).

(Continued)

*Primary Examiner* — Haiss Philogene
(74) *Attorney, Agent, or Firm* — Fay Sharpe LLP

(57) ABSTRACT

Disclosed herein is a class of mm and sub mm wavelength amplifiers and oscillators operating with miniature helical slow wave circuits manufactured using micro fabrication technology. The helices are supported by diamond dielectric support rods. Diamond is the best possible thermal conductor, and it can be bonded to the helix. The electron beam is transmitted, not through the center of the helix, but around the outside. In some configurations the RF power produced may be radiated directly from the slow wave circuit. The method of fabrication, which is applicable above 60 GHz, is compatible with mass production.

48 Claims, 12 Drawing Sheets

OTHER PUBLICATIONS

C. L. Kory and J. A. Dayton, Jr., "Effect of Helical Slow-Wave Circuit Variations on TWT Cold-Test Characteristics," IEEE Trans. ED, vol. 45, No. 4, pp. 972-976 (Apr. 1998).

C. L. Kory and J. A. Dayton, Jr., "Computational Investigation of Experimental Interaction Impedance Obtained by Perturbation for Helical Traveling-Wave Tube Structures," IEEE Transactions on Electron Devices, vol. 45, No. 9, p. 2063, Sep. 1998.

R. T. Benton, C. K. Chong, W. L. Menninger, C. B. Thorington, X. Zhai, D. S. Komm and J. A. Dayton, Jr., "First Pass TWT Design Success," IEEE Trans. ED, vol. 48, No. 1, pp. 176-178 (Jan. 2001).

C. E. Hobrecht, "Resonant Loss for Helix Traveling Wave Tubes," International Electron Devices Meeting, 1978.

P.R. China First Office Action issued Jul. 1, 2010.

PCT International Search Report (Sep. 22, 2008).

European Search Report dated Oct. 21, 2010.

European Search Report dated Sep. 14, 2011.

* cited by examiner

HIGH FREQUENCY HELICAL AMPLIFIER AND OSCILLATOR

PRIORITY

This application claims the benefit of U.S. Provisional Application No. 60/902,537, filed Feb. 21, 2007.

STATEMENT REGARDING FEDERALLY SPONSORED RESEARCH

Financial assistance for this project was provided in accordance with U.S. Government Contract Nos. FA9550-07-C-0076, FA9550-06-C-0081, W911NF-06-C-0086, and W911NF-06-C-0026, and the United States Government may own certain rights to this invention.

BACKGROUND OF THE INVENTION

The present invention relates to the millimeter and sub millimeter wavelength generation, amplification, and processing arts. It particularly relates to electron devices such as traveling wave tubes for millimeter and sub mm wavelength amplifiers and oscillators, and will be described with particular reference thereto. However, the invention will also find application in other devices that operate at millimeter and sub mm wavelengths, and in other devices that employ slow wave circuits.

A traveling wave tube (TWT) is an electron device that typically includes a slow wave circuit defined by a generally hollow vacuum-tight barrel with optional additional millimeter and sub mm wavelength circuitry disposed inside the barrel. An electron source and suitable steering magnets or electric fields are arranged around the slow wave circuit to pass an electron beam through the generally hollow beam tunnel. The electrons interact with the slow wave circuit, and energy of the electron beam is transferred into microwaves that are guided by the slow wave circuit. Such traveling wave tubes provide millimeter and sub mm wavelength generation and amplification.

A generation ago the helical backward wave oscillator (BWO) was the signal source of choice for microwave swept frequency oscillators. However, today this application has been taken over by solid state devices. Helical slow wave circuits are still used as high power millimeter wave traveling wave tube (TWT) amplifiers, producing as much as 200 Watts CW at 45 GHz, but fundamental issues associated with conventional fabrication, thermal management and electron beam transmission are obstacles to higher frequency applications. For decades the conventional practice of helix fabrication has involved winding round wire or rectangular tape around a cylindrical mandrel. As the desired frequency of operation increases, the mandrel diameter must decrease, exaggerating the stress between the inner and outer radii of the helix as the wire thickness becomes a significant fraction of the mandrel radius. Heat generated on the helix whether by electron beam interception or ohmic losses from the RF current must be conducted away through dielectric support rods that are inferior thermal conductors and which frequently make somewhat uncertain thermal contact with the helix. The inside diameter of the helix is reduced as frequency increases, providing a reduced space for conventional electron beam transmission and, therefore, reducing the achievable output power.

The present invention contemplates a new and improved vacuum electron device that resolves the above-referenced difficulties and others.

SUMMARY OF THE INVENTION

In one aspect of the invention a slow wave circuit of an electron device is provided. The slow wave circuit comprises a helical conductive structure, wherein an electron beam flows around the outside of the helical conductive structure and is shaped into an array of beamlets arranged in a circular pattern surrounding the helical conductive structure; a generally hollow diamond barrel containing the helical conductive structure, wherein the hollow barrel is cylindrical in shape; and a pair of diamond dielectric support structures bonded to the helical conductive structure and the hollow barrel.

In another aspect of the invention a slow wave circuit of an electron device having a cathode and a collector is provided. The slow wave circuit comprises: a helical conductive structure between the cathode and the collector, wherein an electron beam flows around the outside of the helical conductive structure and is shaped into an array of beamlets arranged in a circular pattern surrounding the helical conductive structure; a generally hollow diamond barrel containing the helical conductive structure, wherein the barrel is square in shape; and a pair of continuous diamond dielectric support structures bonded to the helical conductive structure and the hollow barrel.

In yet another aspect of the invention a slow wave circuit of a helical traveling wave tube is provided. The output power from the tube is launched directly into free space from a helical antenna that is an extension of the slow wave circuit.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention exists in the construction, arrangement, and combination of the various parts of the device, and steps of the method, whereby the objects contemplated are attained as hereinafter more fully set forth, specifically pointed out in the claims, and illustrated in the accompanying drawings in which:

DETAILED DESCRIPTION

Disclosed herein is a miniature helical slow wave structure in which the helix is fabricated by selectively plating metal into a lithographically patterned circular trench fabricated by reactive ion etching of a silicon wafer. The helix is supported by diamond dielectric support rods. Diamond is the best possible thermal conductor, and it can be bonded to the helix. The electron beam is transmitted, not through the center of the helix, but around the outside. While all of this would be impractical at, say, C-Band, it is feasible to fabricate such a structure for operation in the mm and sub mm wavelength ranges. We shall describe this concept as it applies to both TWTs and BWOs.

Figure 1A:
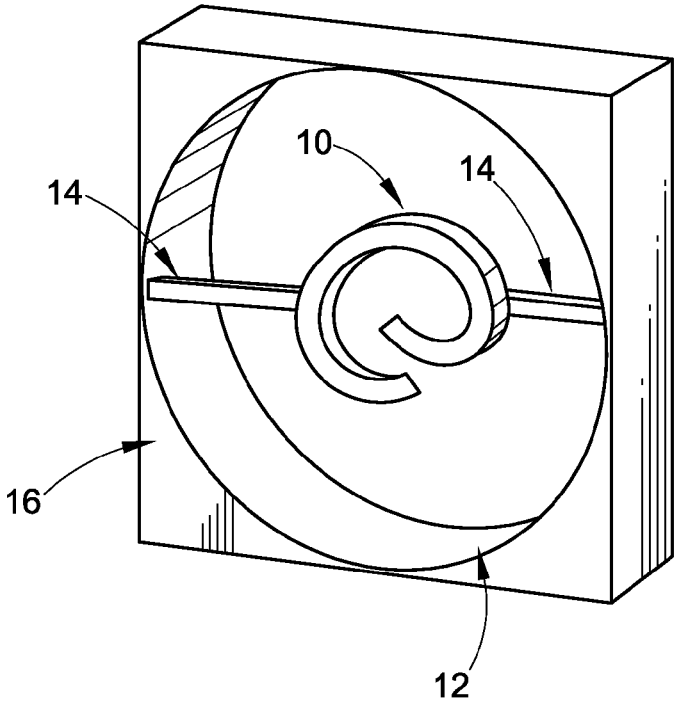
FIGS. 1A and 1B illustrates diamond supported miniature helical slow wave circuits in accordance with aspects of the present invention.
Figure 1B:
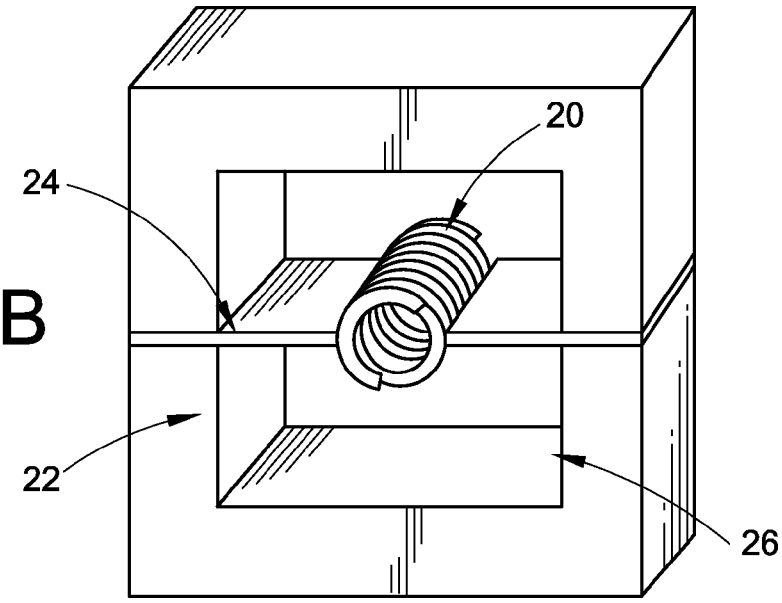

Referring now to the drawings wherein the showings are for purposes of illustrating the exemplary embodiments only and not for purposes of limiting the claimed subject matter, FIGS. 1A and 1B provide views of a miniature helical slow wave circuit. As shown in FIG. 1A, a single turn of helix 10 may be supported in a round diamond barrel 12 by diamond studs 14 that are attached at each half turn. The diamond studs 14 are generally formed by chemical vapor deposition (CVD).

Diamond synthesis by CVD has become a well established art. It is known that diamond coatings on various objects may be synthesized, as well as free-standing objects. Typically, the free-standing objects have been fabricated by deposition of diamond on planar substrates or substrates having relatively simple cavities formed therein. For example, U.S. Pat. No. 6,132,278 discloses forming solid generally pyramidal or conical diamond microchip emitters by plasma enhanced CVD by growing diamond to fill cavities formed in the silicon substrate, and U.S. Pat. No. 7,037,370 discloses alternative methods of making free-standing, internally-supported, three-dimensional objects having an outer surface comprising a plurality of intersecting facets (planar or non-planar), wherein at least a sub-set of the intersecting facets have a diamond layer, the disclosures of each being incorporated by reference herein.

The inside surface 16 of the barrel 12 is metalized. FIG. 1B shows multiple turns of helix 20 supported in a square diamond barrel 22 by a continuous sheet 24 of CVD diamond. As in the previous case the barrel may be fabricated from CVD diamond with the inside surface 26 of the barrel 22 selectively metalized. The unconventional square barrel 22 is introduced to facilitate micro-fabrication processes and for its effectiveness in suppressing unwanted modes. The dimensions of these structures will vary depending on several factors such as the frequency of operation and whether the device is an amplifier or an oscillator, and they are determined using well-known computational techniques previously introduced by the inventors. See "Accurate Cold-Test Model of Helical TWT Slow-Wave Circuits," C. L. Kory and J. A. Dayton, Jr., IEEE Trans. ED, Vol. 45, No. 4, pp. 966-971 (April, 1998); "Effect of Helical Slow-Wave Circuit Variations on TWT Cold-Test Characteristics," C. L. Kory and J. A. Dayton, Jr., IEEE Trans. ED, Vol. 45, No. 4, pp. 972-976 (April, 1998); "Computational Investigation of Experimental Interaction Impedance Obtained by Perturbation for Helical Traveling-Wave Tube Structures," C. L. Kory and J. A. Dayton, Jr., IEEE Transactions on Electron Devices, Vol. 45, No. 9, p. 2063, September 1998; "First Pass TWT Design Success," R. T. Benton, C. K. Chong, W. L. Menninger, C. B. Thorington, X. Zhai, D. S. Komm and J. A. Dayton, Jr., IEEE Trans. ED, Vol. 48, No. 1, pp. 176-178 (January 2001).

Figure 2:
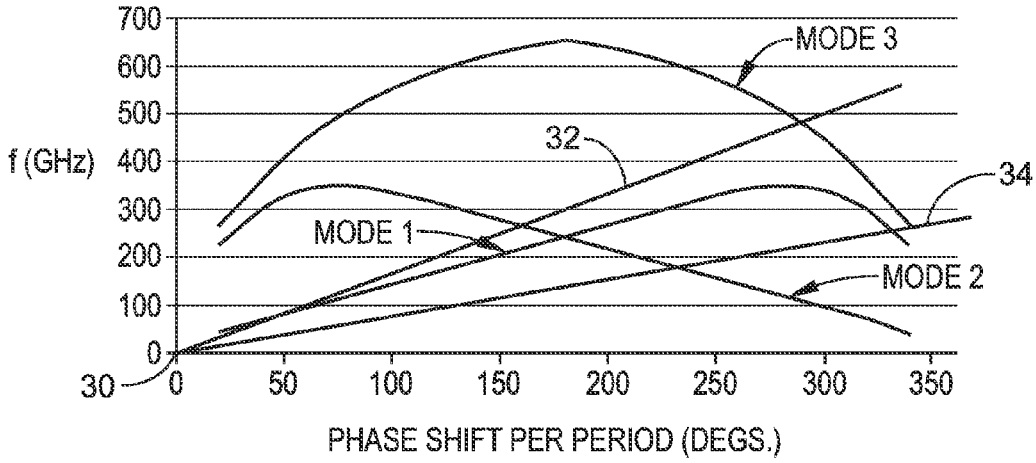
FIG. 2 is a dispersion diagram for the operation of the helix.

In the conventional mode of operation, an electron beam is directed along the axis through the center of the helix. This is one of the factors that have until now prevented helical devices from operating at very high frequencies because the helix inside diameter becomes too small to allow a significant current to pass. One of the innovations here is to allow the current to pass through the relatively larger space outside of the helix. Here the electromagnetic fields are quite different. The helical dispersion relation for the case of a 95 GHz TWT as shown in FIG. 2 indicates the presence of three modes. All of the helical structures described herein have mode diagrams similar to FIG. 2. The configurations shown in FIG. 1 are idealizations of the actual circuits that are fabricated. They are useful to accurately simulate the performance of the miniature helical devices even though the structures that are actually fabricated may differ slightly in some details. The computational techniques used to create FIG. 2 are readily applicable and simulate the exact details of the structures that are manufactured.

The slope of a straight line drawn from the origin 30 in FIG. 2 is proportional to the electron velocity. The slopes of the mode lines are proportional to the group velocity of the wave. The intersections of the electron velocity line and mode lines indicate potential operating points where the velocities of the wave and electrons are in near synchronism. Two electron velocity lines have been drawn on FIG. 2. The upper line 32 intersects Mode 1 at 95 GHz, Mode 2 at 270 GHz and Mode 3 at 480 GHz. The slope at the operating point for Mode 1 is positive, indicating a positive group velocity and, therefore, traveling wave amplification (a TWT). However, at the operating points for Modes 2 and 3 the slope is negative, indicating potentially unwanted nodes that could result in deleterious backward wave oscillations. The intersection with Mode 1 is the first operating point and, therefore, the dominant mode. It is frequently necessary to suppress operation at modes other than the dominant one.

The slower electron velocity line 34 indicates that for operation at a lower voltage the dominant operating point would be at the intersection with Mode 2 at 170 GHz where the device would oscillate (operates as a BWO as opposed to a TWT). This phase velocity line also intersects Mode 1 at 250 GHz and Mode 3 at 270 GHz. Both of these operating points are potential sources of oscillation that could interfere with the dominant mode if they are not suppressed.

Depending on the dimensions and operating voltages selected, these helical devices can be configured either as amplifiers (TWTs) or as oscillators (BWOs). Several methods will be described for the suppression of unwanted modes of operation. Output power is coupled from the BWO circuits into waveguides that are an integral part of the barrel. A horn antenna at the end of the output waveguide may radiate directly from the BWO for quasi optical operation or the waveguide may be terminated in a flange for operation with a closed system. Input power to the TWTs may be accomplished using quasi optical coupling or through waveguides that are an integral part of the barrel. Output power from the TWT may either be radiated directly from a helical antenna that is fabricated as an integral part of the helical slow wave circuit or coupled into a waveguide that is an integral part of the barrel. The electron beams for both the TWTs and the BWOs may be comprised of circular arrays of beamlets that are held in place by the balance of forces resulting from their mutual electrostatic repulsion and their interaction with the axial magnetic focusing fields. The efficiency of both the BWOs and TWTs may be significantly enhanced by utilizing the tail of the focusing magnetic field to trap the spent electron beam in a novel depressed collector.

Annular Multibeam Array

Figure 3:
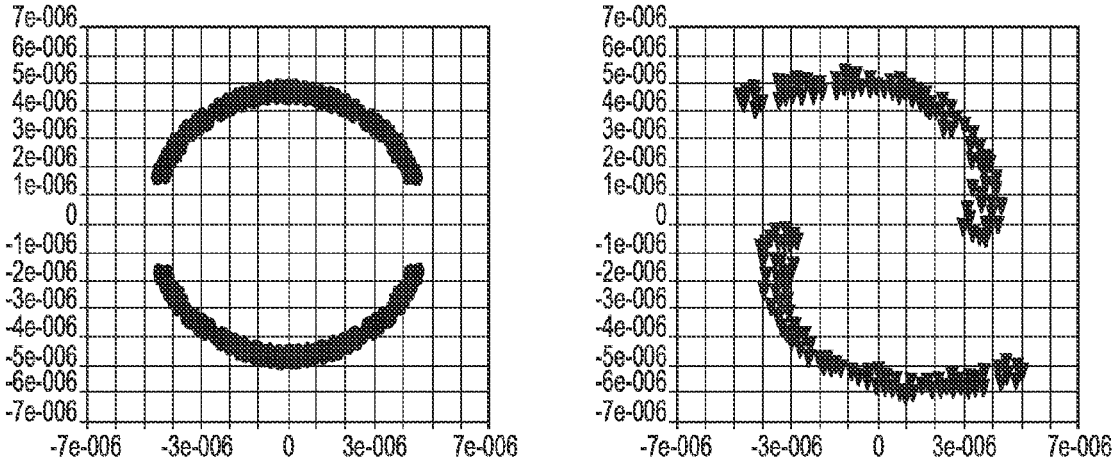
FIG. 3 is a graph showing distortion of the incomplete hollow electron beam. (left) at the cathode, and (right) after propagating in a strong magnetic field.

The electron beam encircling the helix is typically made up of several beamlets arranged in an annular array. The number of beamlets and the current in each one is dependent on the outer diameter of the helix and the current requirements of the device. The beamlets may originate from a field emission array that has been lithographically patterned, from a gridded thermionic cathode, or from an array of small thermionic cathodes. The electron beam is immersed in a focusing axial magnetic field. A continuous hollow beam would be intercepted on the diamond support structure. However, a discontinuous hollow beam becomes unstable as can be seen in FIG. 3 (right). An annular array of beamlets is one solution to produce a stable electron flow. The electrostatic forces between the equally spaced beamlets tend to push them away from each other and from the helix that they surround. They are held in place by the axial magnetic field. In a conventional helical device, the electrostatic forces in the beam push the electrons toward the helix, causing undesirable intercepted current.

Figure 4:
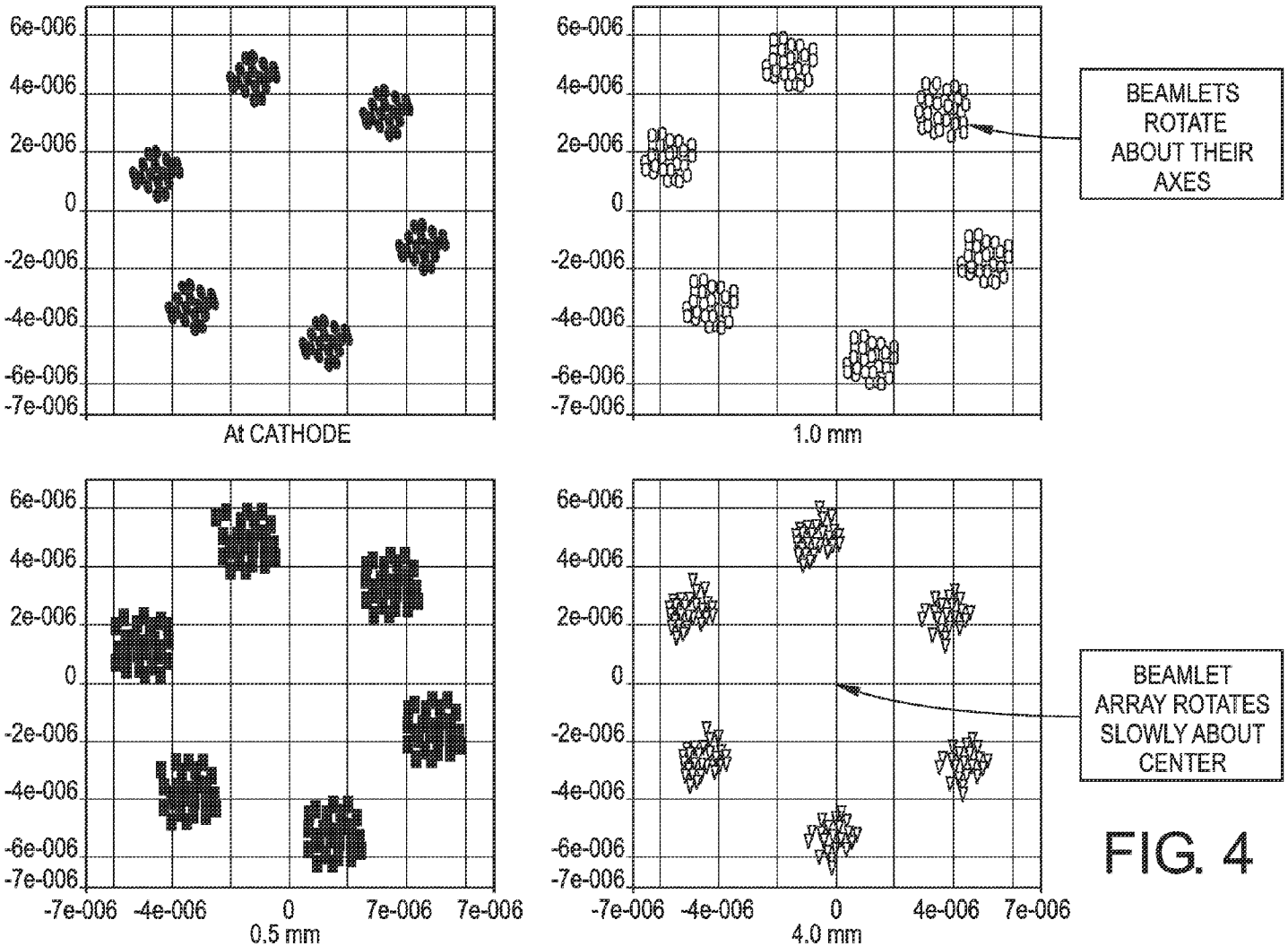
FIG. 4 illustrates the stable propagation of an annular array of beamlets in a strong magnetic field.

An example of this multibeam propagation is shown in FIG. 4, which shows stable propagation of an annular array of beamlets in a strong magnetic field at progressively increasing distances from the cathode. After several mm of travel, the entire array rotates a few degrees about the axis, an effect that can be compensated for by launching the beam at an offsetting angle. The individual beamlets also rotate about their own axes. Again, this example is for the 650 GHz BWO. Each beamlet contains 0.75 mA for a total beam current of 4.5 mA. For other applications at other frequencies the number of beamlets and the current per beamlet is designed as needed.

Figure 5A:
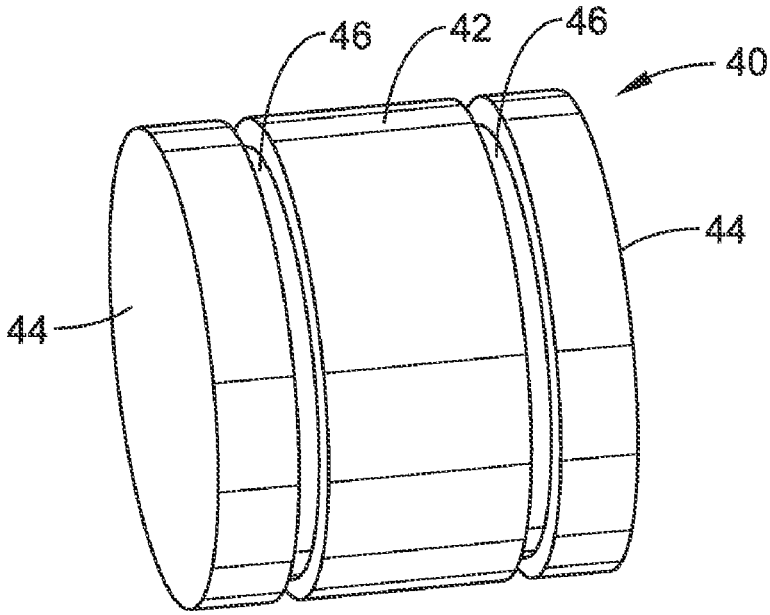
FIGS. 5A and 5B show an elevational view (5A) and a cross-sectional view (5B) of an exemplary magnetic circuit design.
Figure 5B:
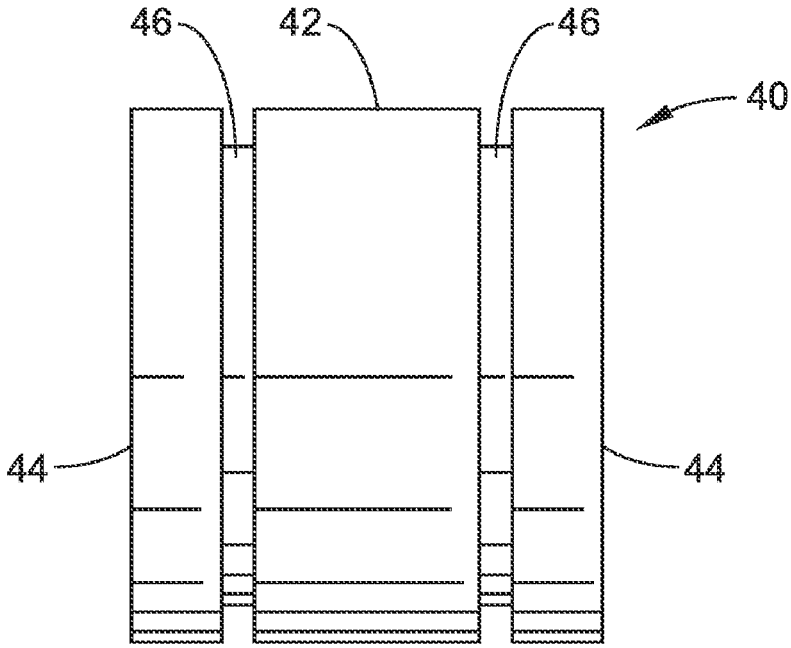
Figure 6:
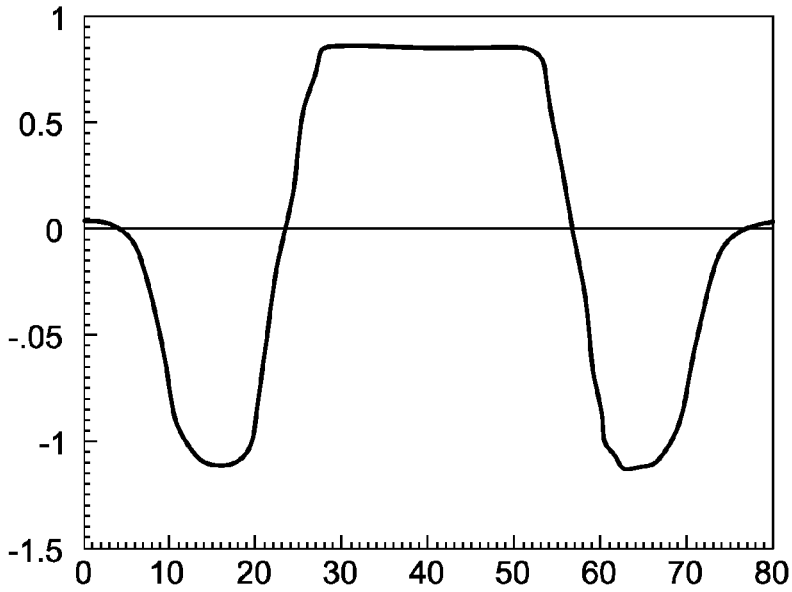
FIG. 6 illustrates the axial magnetic field produced by circuit shown in FIG. 5.

The computations shown in FIG. 4 are based on an array of beamlets launched from a field emission cathode immersed in a 0.85 Tesla axial magnetic field. The magnetic circuit 40 illustrated in FIGS. 5A and 5B demonstrates the feasibility of producing the required magnetic field, which is plotted in FIG. 6. The vertical scale in FIG. 6 is in Tesla and the horizontal scale in mm. The magnetic circuit 40 generally includes a center magnet 42, a pair of end magnets 44, and a pair of pole pieces 46. In this example, the permanent magnets 42, 44 are NdFeB 55 and the pole pieces 46 are permendur. Further, the magnets 42, 44 are 70 mm in outside diameter and 6 mm in inside diameter. The lengths are 30 mm for the central magnet 42 and 12 mm for the side magnets 44. The pole pieces 46 are 60 mm in diameter and 4 mm long.

Sub mm BWO

Figure 7:
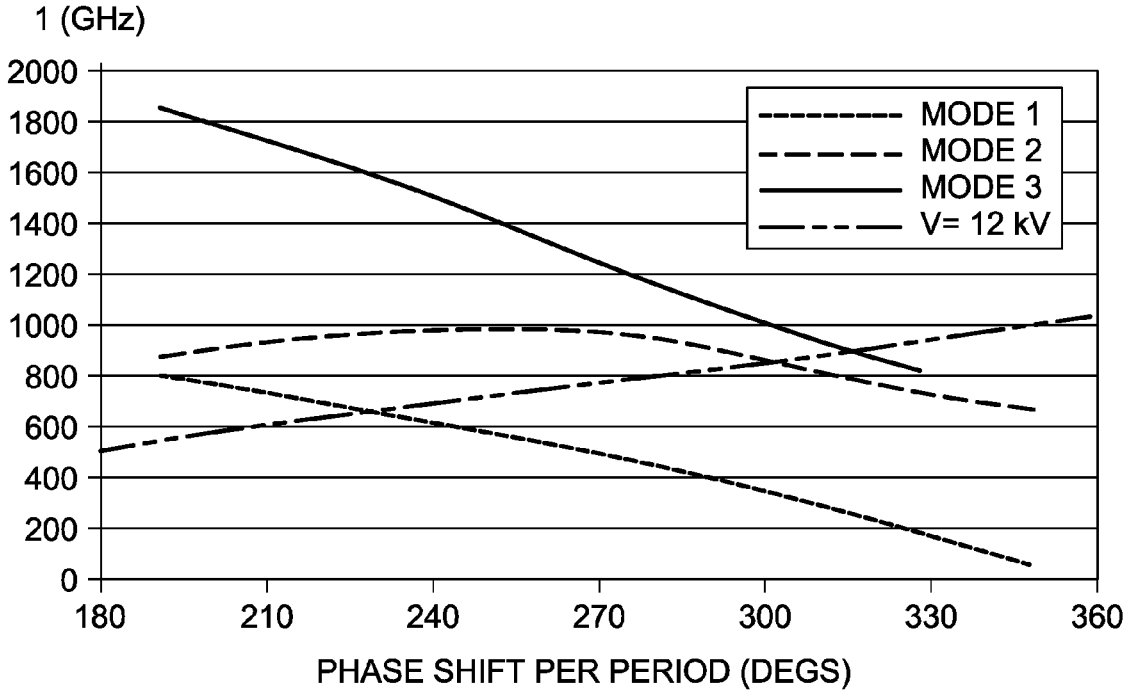
FIG. 7 represents a segment of the dispersion diagram for operation as a 650 GHz BWO.

FIG. 2 illustrates the operation of the miniature helical slow wave circuit as a BWO with a dominant oscillating mode and two competing higher order modes. A segment of the dispersion diagram, modified from FIG. 2 for BWO operation at 650 GHz, is shown in FIG. 7. For convenience, the dominant oscillating mode has been designated as Mode 1 in FIG. 7. Dispersion diagrams such as this are produced from computer simulations using the exact circuit dimensions. In this case the configuration simulated in FIG. 7 is for a BWO with a round barrel and with diamond stud supports. The electron velocity line is drawn for a 12 kV electron beam. Three methods were found to suppress the two undesirable higher order modes with relatively little impact on the dominant mode: The inside wall of the barrel could be coated with a high resistivity material. The barrel could be made square as shown in FIG. 1B.

Figure 8:
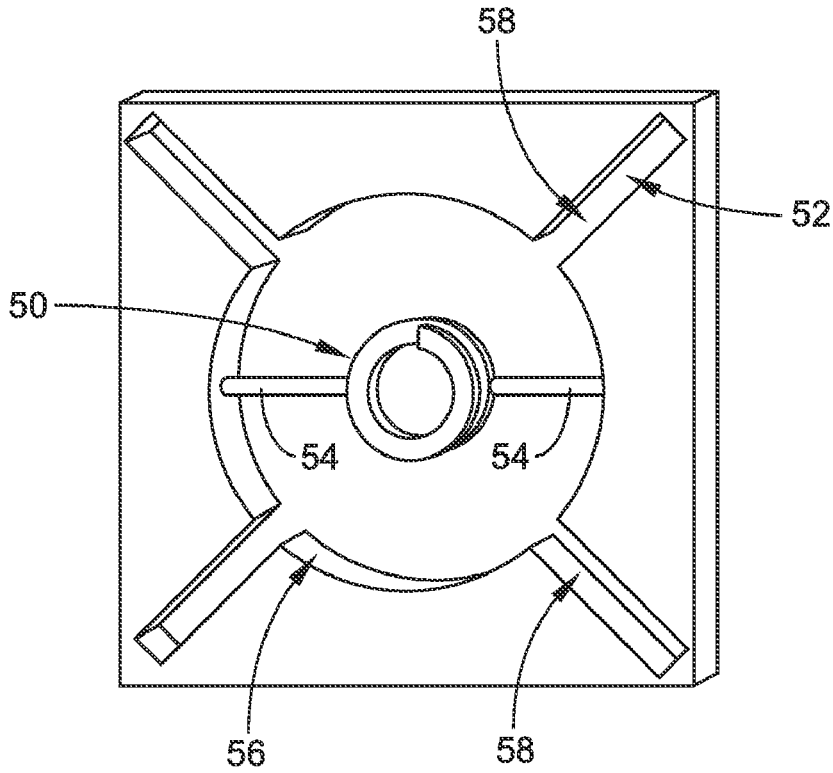
FIG. 8 illustrates a BWO with slotted barrel for suppression of unwanted modes.

FIG. 8 shows a single turn of helix 50 supported in a slotted diamond barrel 52 by diamond studs 54 that are attached at each half turn. As in the previous case the barrel may be fabricated from CVD diamond with the inside surface 56 of the barrel 52 selectively metalized. Slots 58 are incorporated to disrupt higher order modes. The helix, as shown in FIG. 1A and in FIG. 8, is supported by diamond studs, which is the most efficient configuration. However, replacing the diamond studs with a continuous sheet of diamond as shown in FIG. 1B may in some cases provide for a more robust structure with an acceptable penalty in lower efficiency. The final design may be obtained by optimizing the computer simulations.

By way of an example, the dimensions of a typical BWO circuit utilizing a square barrel, operating at 6 kV, and supported by a continuous diamond sheet are presented in Table 1 below. The predicted power output from this design depends on the current and current density in the electron beam and the proximity of the beam to the circuit. The choice of these factors involves engineering tradeoffs. Increasing the current and current density places more stress on the electron source and magnetic focusing systems, while bringing the electron beam closer to the helix increases the possibility of beam interception. For the BWO described in Table 1, operated at 650 GHz with the 4.5 mA electron beam shown in FIG. 4, computer predictions indicate an output power of 70 mW. If the current could be increased to 10 mA, the output power would be 270 mW. Power can be further increased by operating at a higher voltage.

TABLE 1

Circuit Dimensions (microns) for Helical BWO with Square Barrel

| | |
|---|---|
| Helix Pitch, p | 44.76 |
| Support Rod thickness, th | 10 |
| Helix outer diameter, diamo | 62.5 |
| Helix inner diameter, diami | 42.5 |
| Helix tape width, tapew | 26 |
| Barrel width, barreld | 200 |
| Helix thickness, rth | 10 |

Helix to Waveguide Coupler

Figure 9:
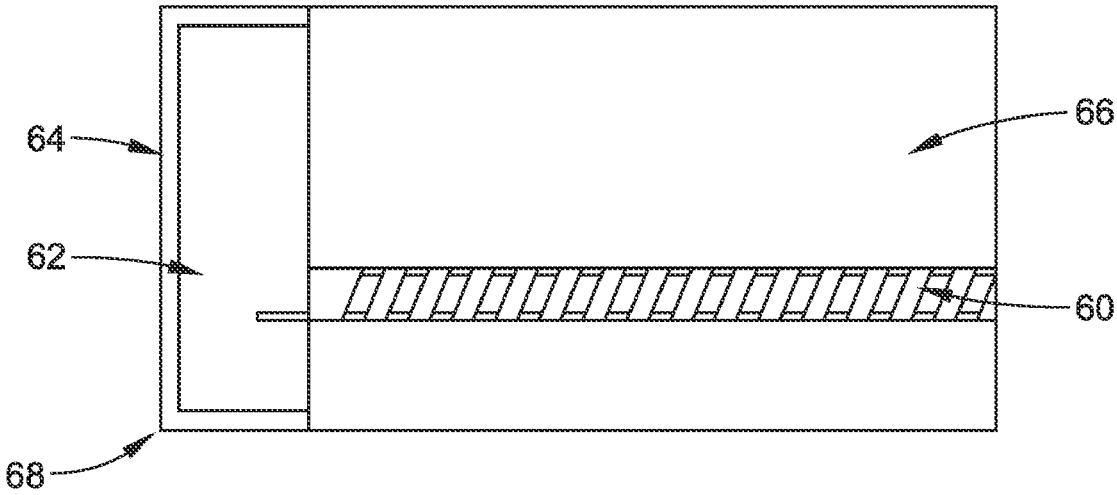
FIG. 9 is a cross sectional view of the probe in waveguide coupler.
Figure 10:
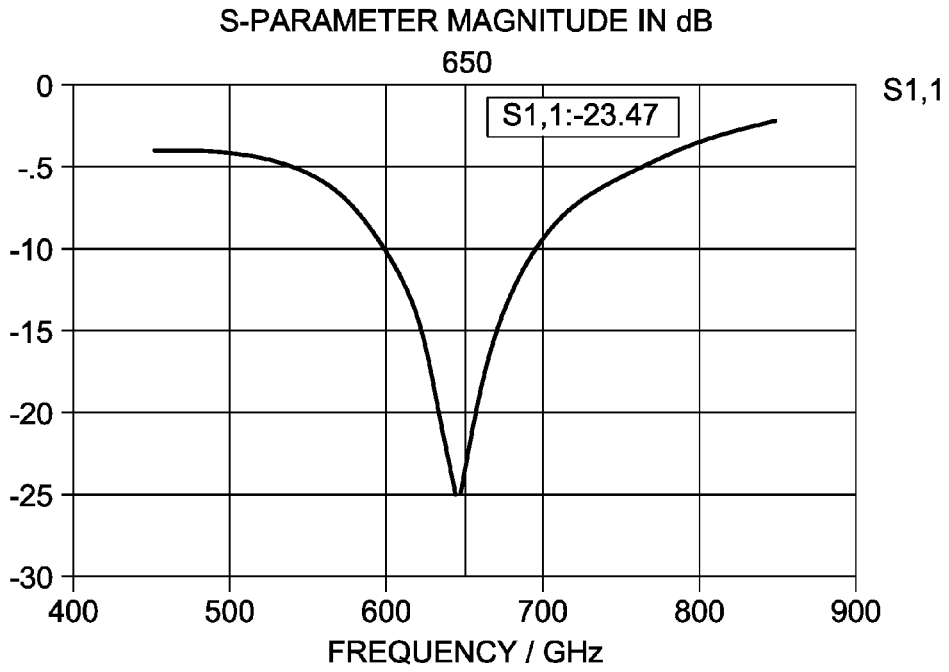
FIG. 10 is a graph showing return loss for the probe in waveguide configuration.

A helix to waveguide coupler is essential for providing an output path for the power produced by the BWO. One form of this coupler is shown in FIG. 9. The same scheme can be used at the input to the TWT and as an alternate output coupler for the TWT. The end of the helix 60 is extended to create a probe 62 that can pass through the broad wall of a rectangular waveguide 64 that is built into the tube body. Also shown in the figure is a continuous diamond support sheet 66 and a matching short 68. The return loss for such a coupler designed for the 650 GHz BWO is shown in FIG. 10.

BWO Collector Design

Figure 11:
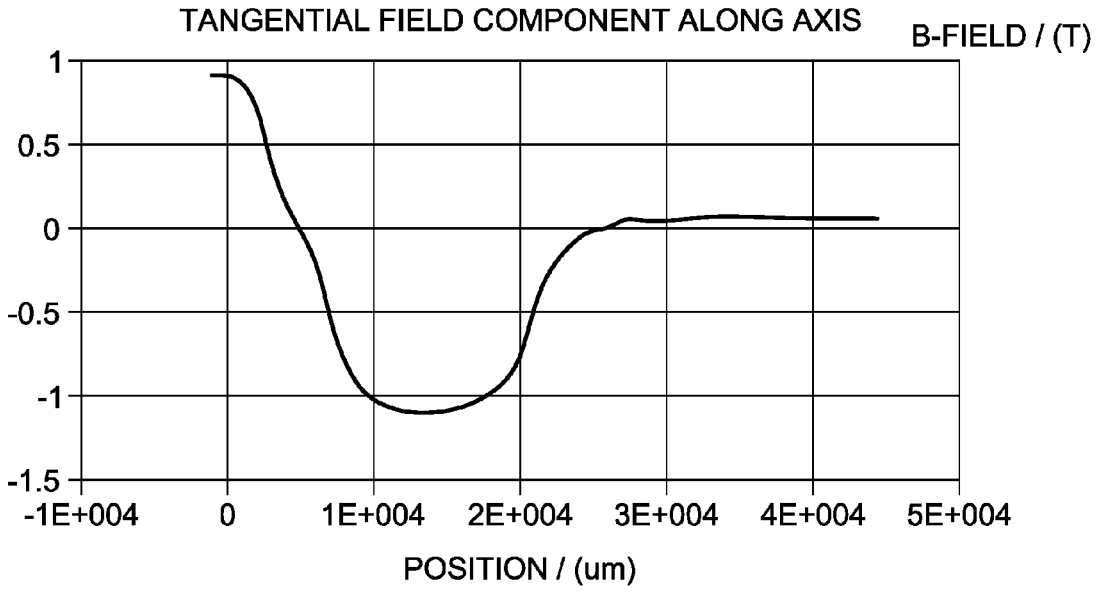
FIG. 11 is a graph showing tailing magnetic field in the vicinity of the collector.
Figure 12:
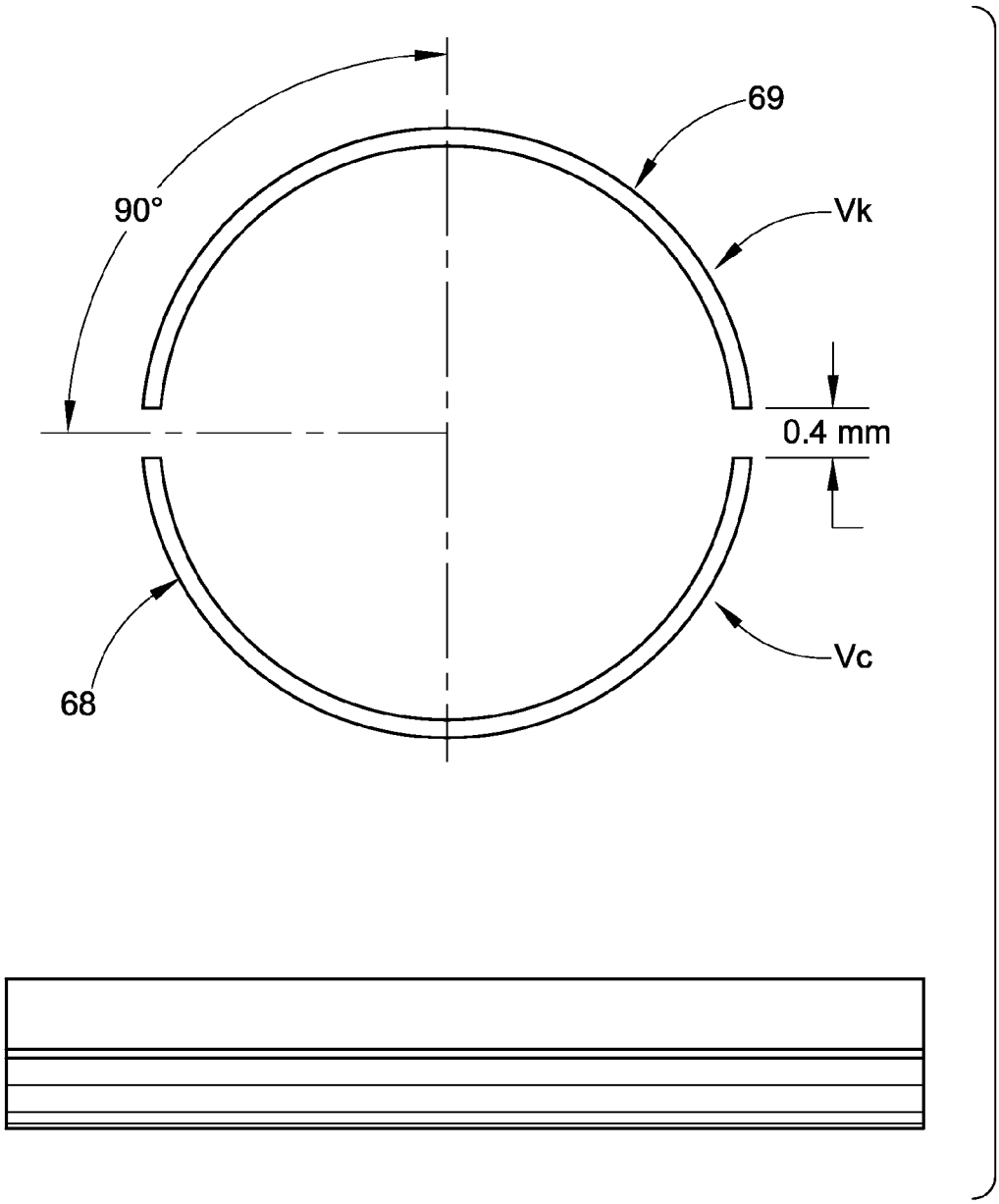
FIG. 12 illustrates the collector geometry in cross section (left) and side view (right)
Figure 13:
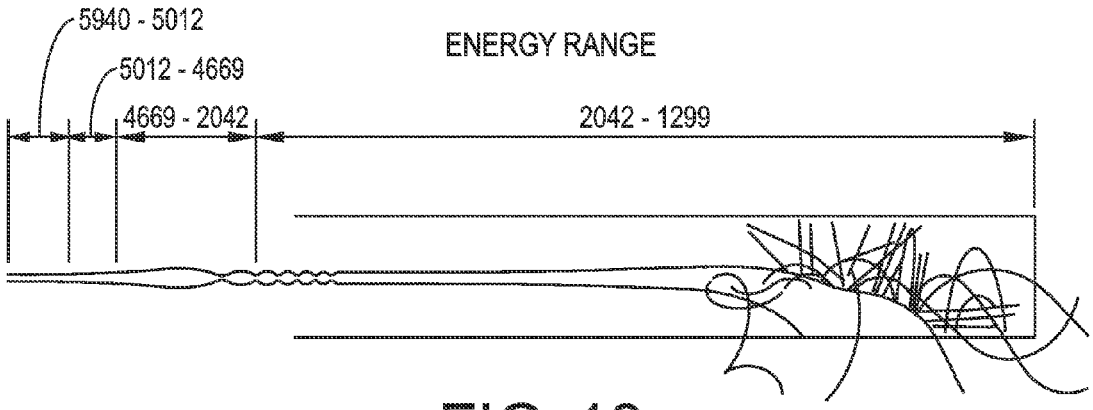
FIG. 13 is a side view of the electron trajectories in the BWO collector.

The helical slow wave circuit extracts only a small fraction of the power in the electron beam. After passing through the slow wave circuit the electron beam is slowed and captured at relatively low energy in the depressed collector. FIG. 11 shows the tail of the magnetic field first seen in FIG. 6. This magnetic field coupled with a transverse electrostatic field formed by the collector electrodes 68, 69 shown in FIG. 12 slows the electrons in the spent beam to approximately 5% of their energy and traps them on a supporting structure thermally isolated from the slow wave circuit. One collector geometry that satisfies our requirements is a split cylinder with the upper half set at the cathode voltage and the lower half at the collector voltage, typically biased 300 V above the cathode voltage. For operation with the 650 GHz BWO, the simulated electron trajectories in the collector are shown in FIG. 13.

BWO Body Layout

Figure 14:
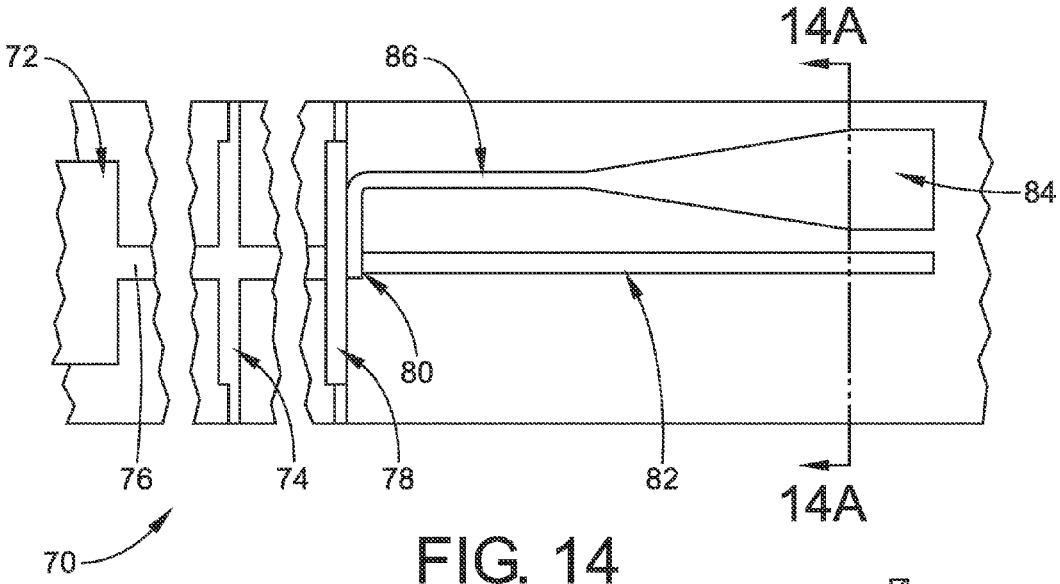
FIG. 14 is a layout of the BWO body half and an end view of the assembled BWO structure.
Figure 14A:
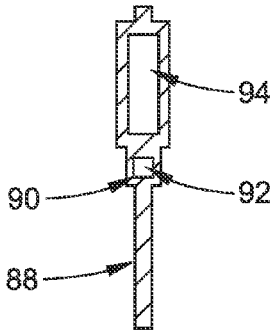

The BWO body that houses the slow wave circuit and the electron gun may be formed by depositing diamond over an array of ridges on a silicon mold, patterned by deep reactive ion etching. When the silicon is removed the remaining diamond will be in the form of an array of half boxes. A detailed sketch of an exemplary BWO housing 70 is shown in FIG. 14. The left side of the figure represents the location of the cathode mount 72, and the first anode 74, which are separated by lengths 76 of insulating diamond. The cross hatched area represents the location of the second anode 78. The details of the anode slots in the electron gun are shown on the left, and the output coupler 80 and the barrel 82 of the slow wave circuit are on the right. Also shown is a horn antenna 84 and an output waveguide 86. The barrel 82 has a depth of 100 microns and the remaining elements have a depth of 190 microns as generally required for the 650 GHz BWO. Also shown is a cross-sectional view featuring the diamond housing 88, the barrel aperture 90, the helix 92, and the horn antenna aperture 94. The barrel 82, waveguide 86, horn antenna 84, anode slots 74, 78, and portions of the cathode mount 72 are all selectively metallized.

Figure 15:
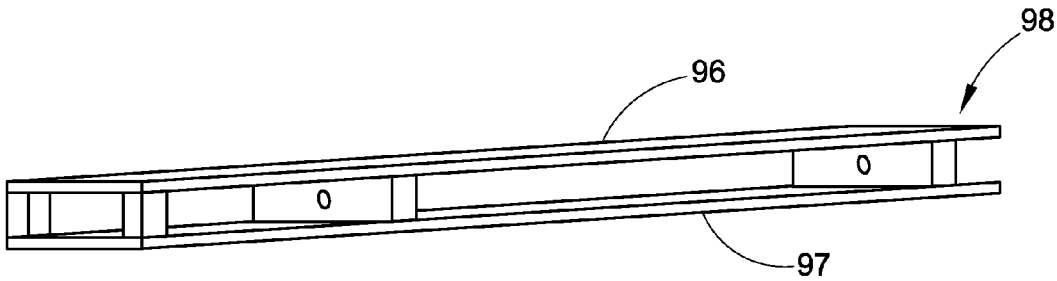
FIG. 15 is a computer simulation of the electron gun with the sides removed.

A more detailed description of the electron gun is shown in FIG. 15, wherein the sides are removed. Reference numerals 96 and 97 refer to the top and bottom portions, respectively, of the diamond box 98 that houses the BWO and provides the electrical isolation in the gun and the barrel of the slow wave circuit. The slow wave circuit as shown in FIG. 14 is 6 mm long. The layout can be extended in length as needed for longer slow wave circuits. The output waveguide, which is formed as an integral part of the housing is flared at the end to create a horn antenna. After the anodes and the array of helical slow wave circuits are inserted into the lower half of the array of bodies, the upper half is added and the entire structure is bonded. The individual BWOs are removed from the bonded array by laser dicing. The view of the output end of the assembled BWO is also shown in FIG. 14. The slow wave circuit is positioned on the axis of the magnetic field. The RF output is off axis and directed through the collector to a window at the end of the vacuum envelope. For the case of a 650 GHz BWO, the barrel 82 is 100 microns deep, while the remaining areas of the layout are 190 microns deep. Of course, when the two halves are assembled, these dimensions are doubled so that the depth of the slow wave circuit barrel 82 is 200 microns and the waveguide and electron gun dimensions are 380 microns.

Miniature Helical TWT

Figure 16:
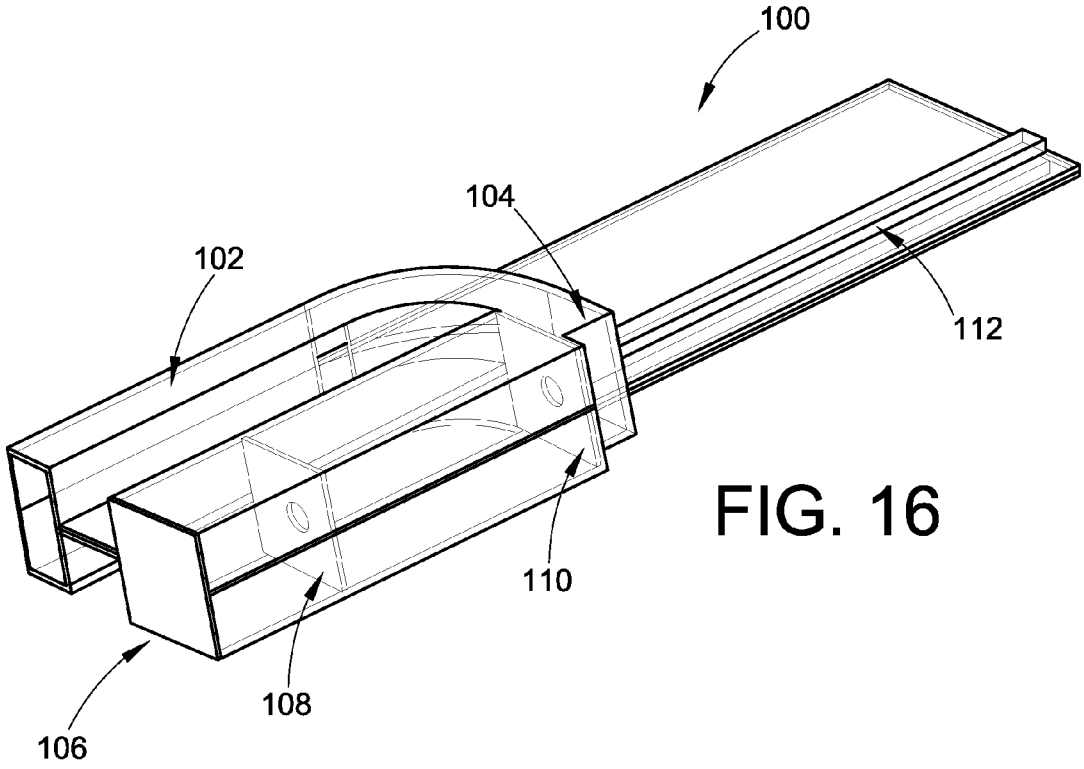
FIG. 16 is a diagram of the assembled TWT with the diamond housing as a transparent box.

Much of what has been described for the BWO applies to the TWT. However, there are some differences. Because the TWT is an amplifier, it must have an input coupler, and, because the output is at the end of the tube rather than in the middle, it is possible to radiate the output power directly from the slow wave circuit without going through a waveguide. Because of the very high frequency it may be possible to couple into the input of the TWT quasi-optically through an antenna as well as the waveguide. FIG. 16 is a diagram of the TWT 100, showing the diamond housing as a transparent box surrounding the TWT 100. The TWT 100 includes a waveguide 102, a probe 104, a field emission cathode 106, a first anode 108, a second anode 110, and a helix 112. A sketch of the BWO would appear quite similar with the exception that there would be no input waveguide.

Figure 17:
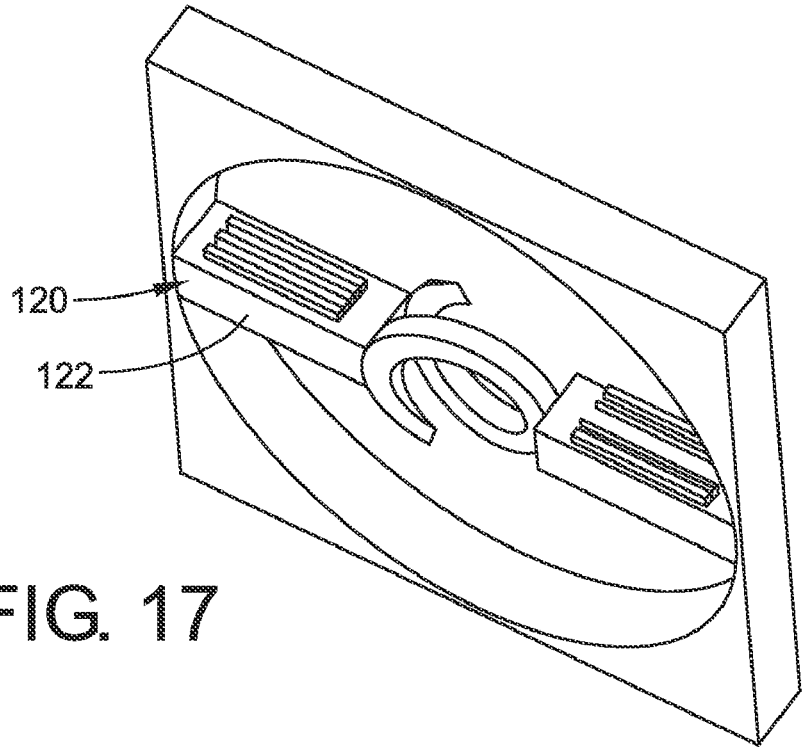
FIG. 17 is a diagram showing resonant loss structures deposited on the TWT diamond support sheets.

As noted with respect to FIG. 2, in addition to the desired amplifying mode for the TWT there are two undesirable backward wave modes. The methods that were used to suppress undesirable higher order modes in the BWO are not applicable to the TWT. If the higher order modes are a problem they must be eliminated by inserting resonant loss patterns 120 on the diamond support structure 122 as shown in FIG. 17. See "Resonant Loss for Helix Traveling Wave Tubes," C. E. Hobrecht, International Electron Devices Meeting, 1978.

Figure 18:
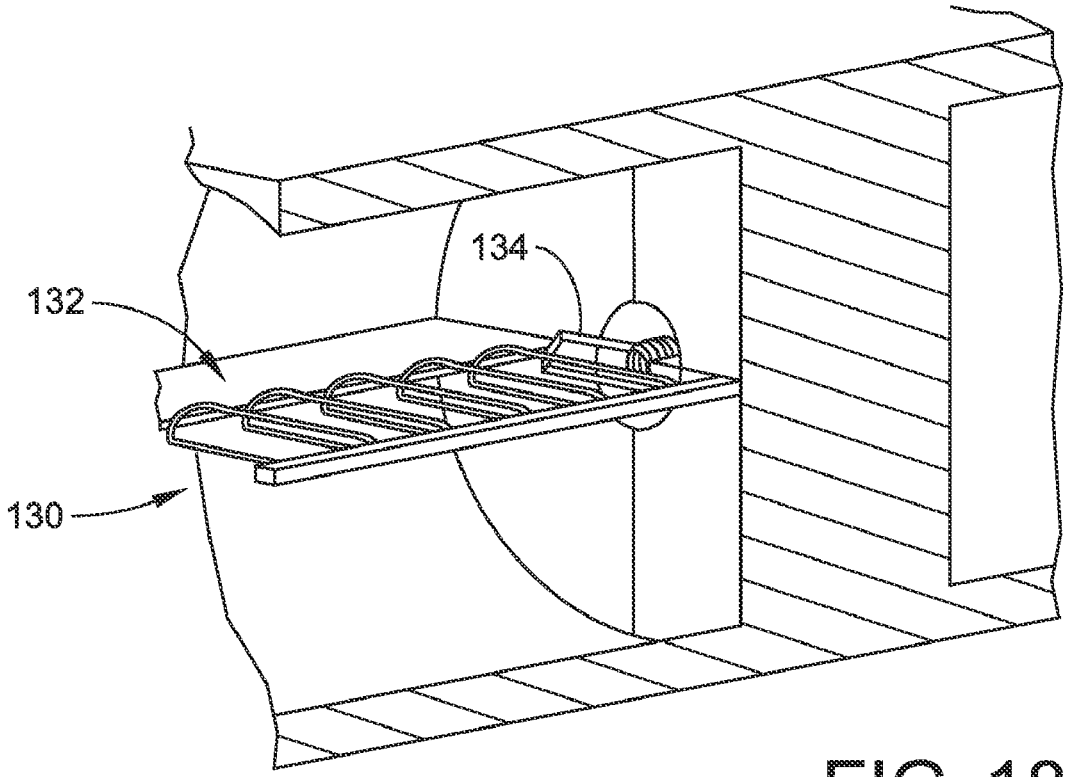
FIG. 18 is a cross section of helical antenna output.

The output from the TWT is radiated directly from the slow wave circuit through a helical antenna that is fabricated as an integral part of the helical slow wave circuit. This will eliminate one of the principal failure points in high power mm wave tubes, the connection from the slow wave circuit to the output waveguide. In the computer simulation as represented in FIG. 18, one half of the structure is cut away to show the detail of the helical antenna 130. Also shown are the continuous diamond support sheet 132 and the helical slow wave circuit 134. This antenna produces a linearly polarized wave. The antenna directivity can be enhanced by using it as a feed for a pyramidal horn. The antenna is directed toward a window in the vacuum envelope.

Helical Slow Wave Circuit Fabrication

All of the TWTs and BWOs described herein are based on the miniature helical slow wave circuit, whereby the helix is fabricated using micro-fabrication techniques such as lithography, reactive ion etching, deep reactive ion etching and selective metallization. To give some perspective, for a 650 GHz BWO the outer diameter of the helix is only 62.5 microns. The helix is supported by a sheet of CVD diamond or by CVD diamond studs.

Figure 19A:
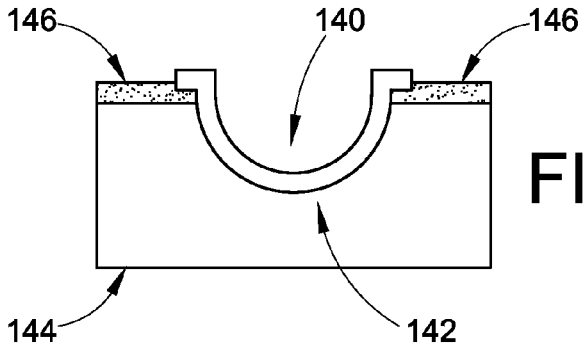
FIGS. 19A-C illustrate one method of fabricating the diamond supported helix.
Figure 19B:
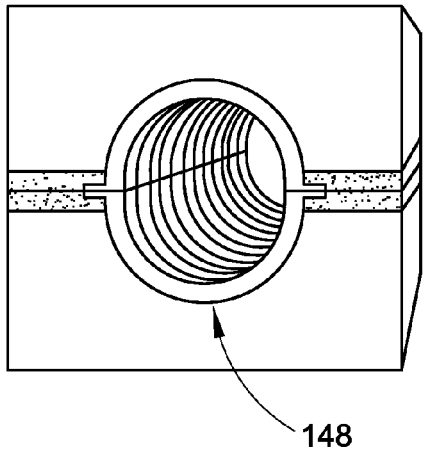
Figure 19C:
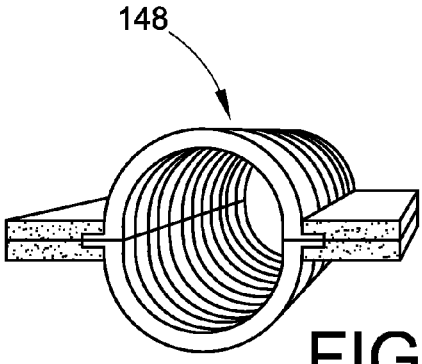

One method of fabricating the helical slow wave circuit is illustrated in FIGS. 19A-C. In FIG. 19A, a metallic half helix 140 has been deposited in a cylindrical trench 142 etched into a diamond coated silicon wafer 144. Also shown is a diamond sheet 146 on either end of the trench 142. In FIG. 19B, two silicon backed helix halves 140 are aligned and bonded to form a helix 148. In FIG. 19C, the silicon 144 has been removed to finalize the production of the diamond supported helix 148.

A silicon wafer is coated with a diamond film and then etched lithographically to produce arrays of openings for the electron guns and helices. Circular trenches are etched into the diamond coated silicon wafers to form the desired shape of the helical outside diameter. The circular trenches are lithographically patterned and selectively metalized to produce an array of half helices. These are bonded together, and, when the silicon is removed, an array of diamond supported helices remains.

The barrel of the helix may also be fabricated using microfabrication technology. A mold is created by etching an array of ridges into a silicon wafer. Then diamond is grown on the wafer and the silicon removed. The result is an array of diamond half boxes that serve as the tube bodies. The tube bodies incorporate the barrel of the helical slow wave circuit, the dielectric insulation for the electron gun, and the input and output waveguides, as required. Alignment of these parts is assured because they are fabricated in the same operation and become one solid piece of diamond. For lower frequency mm wave devices more conventional machining techniques may be satisfactory for manufacturing the bodies. The array of helices is placed on the bottom half box, the top box is added and the entire assembly bonded together.

Figure 20:
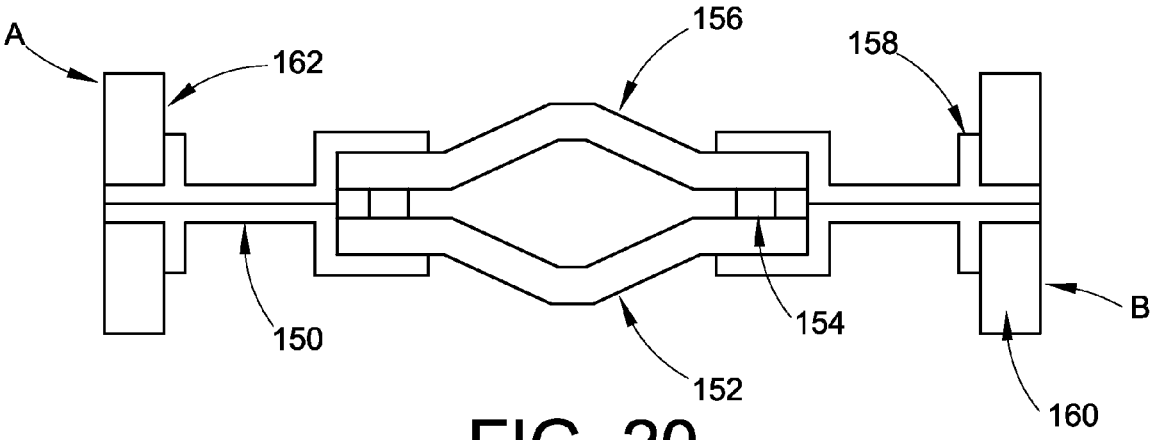
FIG. 20 is an illustration showing the realistic distortions of the ideal helical geometry likely introduced by the fabrication techniques.

The diagram shown in FIG. 19 is an idealization of the helical structure. The sketch in FIG. 20 shows the resulting structure somewhat more realistically, showing the realistic distortions of the ideal helical geometry likely introduced by the fabrication techniques. Diamond support rods 150 overlap on the bonding pads of the metal helix 152. The bonding material generally comprises a solder ball 154. The actual outer surface of the resulting helix 156 is not likely to be perfectly round, depending on the shape of the trench etched into the silicon. The alignment of the helix 156 with the electron beam will be controlled by detents 158 in the diamond support sheet 150 that align with the walls 160 of the barrel to guide the slow wave circuit into the center of the barrel. Also note that the inside 162 of the barrel is metalized.

In order to accomplish the bonding between the helix and the diamond and between the two circuit halves, there must be metal tabs on each side of the structure and the bonding material itself will distort the structure further. The extent of these deviations from the ideal case will depend on the fabrication technology and also on the frequency of operation. However, none of this invalidates the analysis that has been presented above. The actual dimensions and shape of the helix can be accommodated by the computer simulation techniques employed here and adjusted to obtain the desired performance.

In conventional vacuum electronics, devices are manufactured one at a time from hundreds of component parts by skilled technicians. These devices will be fabricated on a wafer scale that is compatible with mass production. Two wafers will be required to make an array of helices, and two more wafers will make an array of bodies. The four wafers are bonded together, the silicon removed, and in the final step the individual devices are separated by laser dicing. Again, using the 650 GHz BWO as an example, approximately 50 devices can be fabricated from four 100 mm diameter silicon wafers, greatly reducing the per unit cost of the devices.

The typical helical slow wave circuit is limited in operation to frequencies below 60 GHz, typically much below. The helical circuits described here can be designed to operate as a BWO or a TWT in the range from 60 GHz to a few THz.

The helix is not fabricated in the conventional manner by winding a metal wire or tape around a mandrel. These helices are produced using microfabrication techniques, which may include reactive ion etching, lithography, selective metallization, and die bonding.

For high frequency conventional helices the thickness of the wire or tape becomes a significant fraction of the mandrel radius, which creates significant stress in the outside of the helix and results in distortion and structural failure. There is no such effect in these helices.

The helices will take on the approximate round shape of conventional helices. The actual details of the helix shape will be modeled computationally to arrive at the final design.

The helix pitch can be controlled lithographically to produce tapered circuits that keep the electromagnetic wave in synchronism with the electron beam for enhanced efficiency.

The conventional helix is held under high compressive force in a round barrel typically by three dielectric rods. This helix is not under great compressive stress; it is bonded at 180 degree intervals to chemical vapor deposited (CVD) diamond supports that may be continuous sheets or studs that attach to each half turn of the helix.

The dielectric rods used in conventional helix circuit fabrication have relatively poor thermal conductivity. The CVD diamond supports used here have the highest known thermal conductivity.

The thermal conductivity between the conventional helix and the dielectric rods is a highly nonlinear function of the compressive force between them. This force is a function of temperature, so, as the barrel is heated during high power operation, the thermal capacity of the tube is reduced. Here the CVD diamond supports are bonded to the helix. The thermal conductivity across this bond is not a function of temperature.

In the conventional helical vacuum electron device, the electron beam passes through the center of the helix. At high frequency, the diameter of the helix is reduced to the point that a meaningful current cannot pass through it. In these devices the electron beam is directed around the relatively larger space outside of the helix.

The conventional hollow electron beam is susceptible to instabilities. The electron beam used here is comprised of multiple beamlets arranged in a stable annular array.

The multibeam array may be formed from a gridded thermionic cathode, multiple thermionic cathodes, or from a patterned field emission array.

In a conventional helical vacuum electron device, the space charge forces push the electrons toward the helix causing beam interception, which can reduce efficiency and cause failure. In these devices the space charge forces between the beamlets push them away from each other and, therefore, away from the helix.

In the conventional helical vacuum electron device, the barrel surrounding the helix is round. In this device the barrel may be square in some applications for ease of fabrication and to eliminate unwanted modes of operation.

In a conventional vacuum electron device the electron gun and the slow wave circuit are fabricated separately and then welded together. The precision of alignment of these two parts, which is critical to the device performance, is compromised by the tolerances of the welding operation. In these devices the barrel of the slow wave and the wall of the electron gun are fabricated as a unit and, therefore, aligned precisely.

The electron gun walls will be slotted to receive anode inserts and to provide electrical connections to the anodes when selectively metalized.

The anodes may be fabricated from metal foils that have been formed using electrical discharge machining or they may be fabricated from high conductivity silicon that has been formed by lithography and deep reactive ion etching or other microfabrication processes.

In a conventional helical vacuum electron device the barrel is fabricated from metal. In this device the barrel may be fabricated from CVD diamond that has been selectively metalized.

In a conventional vacuum electron device the electron gun, slow wave circuit and input/output coupler are fabricated as separate elements and welded together. In this device they are fabricated as a single unit within the CVD diamond housing to achieve precise alignment.

Conventional vacuum electron devices are assembled from hundreds of parts one at a time by skilled technicians. This device will be fabricated on wafer scale mass production that will produce as many as 50 devices from a single operation using four 100 mm silicon wafers, resulting in significant per unit cost savings.

In conventional TWTs the output power is coupled from the slow wave circuit to a waveguide or transmission line. That scheme can also be adapted to this device. However, this TWT will be designed to radiate the RF output power directly from the slow wave circuit through a helical antenna that is fabricated as an integral part of the helical slow wave circuit.

For a conventional TWT, the input power is brought into the device through a waveguide or coaxial line. In this device, because of the very high frequency, the input power may be brought in through an antenna or a quasi optical coupler.

The output of the helical antenna may be fed into a small horn antenna to increase the antenna directivity.

Waveguides are formed as integral elements of the device barrel to serve as input or output transmission lines for the TWT and as output transmission lines for the BWO.

A probe, which is fabricated as an extension of the helical slow wave circuit, couples to the input or output waveguide through an opening in the broad wall of the waveguide.

A short circuit is fabricated into the waveguide to match the probe to the waveguide.

For the BWO, unwanted higher order modes are suppressed by coating the inside of the barrel with a low conductance material, by slotting the barrel periodically, or by fabricating the barrel as a square, rather than a round structure.

For the TWT, unwanted higher order modes are suppressed by adding resonant loss to the diamond support sheets.

The spent beam emerging from the BWO is captured at low energy in a two stage collector that traps the electrons between crossed magnetic an electrical fields. The spent beam emerging from the TWT is captured in a multistage depressed collector.

The output power from the BWO is radiated from the BWO housing through a horn antenna fabricated at the end of the output waveguide.

The above description merely provides a disclosure of particular embodiments of the invention and is not intended for the purposes of limiting the same thereto. As such, the invention is not limited to only the above-described embodiments. Rather, it is recognized that one skilled in the art could conceive alternative embodiments that fall within the scope of the invention.

We claim:

1. A slow wave circuit of an electron device, the slow wave circuit comprising:

a helical conductive structure, wherein an electron beam flows around the outside of the helical conductive structure and is shaped into an array of beamlets arranged in a circular pattern surrounding the helical conductive structure;

a generally hollow barrel containing the helical conductive structure; and a pair of dielectric support structures attached to the helical conductive structure and the hollow barrel.

2. The slow wave circuit of claim 1, wherein the electron device comprises a traveling wave tube (TWT).

3. The slow wave circuit of claim 2, wherein a spent beam emerging from the TWT is captured in a multistage depressed collector.

4. The slow wave circuit of claim 1, wherein the electron device comprises a backward wave oscillator (BWO).

5. The slow wave circuit of claim 4, wherein a spent beam emerging from the BWO is captured at low energy in a two stage collector that traps the electrons between crossed magnetic and electrical fields.

6. The slow wave circuit of claim 1, wherein the hollow barrel includes four equally spaced slots placed symmetrically about the pair of dielectric support structures.

7. The slow wave circuit of claim 1, wherein the dielectric support structures are comprised of diamond.

8. The slow wave circuit of claim 1, wherein the hollow barrel is comprised of diamond.

9. The slow wave circuit of claim 1, wherein the circuit operates at a frequency greater than 60 GHz.

10. The slow wave circuit of claim 1, wherein said helical conductive structure is integral with said support structures.

11. The slow wave circuit of claim 10, wherein said helical conductive structure is supported at every turn thereof.

12. The slow wave circuit of claim 10, wherein said helical conductive structure is supported on diametrically opposite sides by substantially co-planar supports.

13. The slow wave circuit of claim 12, wherein said supports include resonant loss patterns on at least one surface thereof.

14. The slow wave circuit of claim 10, wherein said support structures are studs.

15. The slow wave circuit of claim 1, wherein the pitch of said helical conductive structure is variable over the length thereof.

16. The slow wave circuit of claim 15, wherein said pitch is tapered for beam synchronism.

17. The slow wave circuit of claim 12, wherein said supports are dielectric.

18. The slow wave circuit of claim 12, wherein said supports are diamond.

19. The slow wave circuit of claim 1, wherein said helical conductive structure comprises two one-half helices bonded together.

20. The slow wave circuit of claim 1, including means for selective mode suppression.

21. The slow wave circuit of claim 1, wherein the hollow barrel is cylindrical in shape.

22. The slow wave circuit of claim 2, wherein the number of the beamlets is a function of the size of the helical conductive structure.

23. The slow wave circuit of claim 2, wherein number of the beamlets is a function of the current requirements of the slow wave circuit.

24. The slow wave circuit of claim 2, including a cathode; and wherein the array rotates about its axis less than about 5° per 4 mm axial travel to thereby avoid interference by the support structures for the helical conductive structure.

25. The slow wave circuit of claim 2, wherein the number of said beamlets is 6; and wherein the circumferential spacing of the beamlets is substantially equal.

26. The slow wave circuit of claim 2, including plural thermionic cathodes.

27. The slow wave circuit of claim 2, including plural field emitters.

28. The slow wave circuit of claim 2, including a single gridded cathode.

29. The slow wave circuit of claim 9, wherein said helical conductive structure is sized for operation at approximately 650 GHz.

30. The slow wave circuit of claim 9, where helical conductive structure is sized for operation over a bandwidth from about 60 GHz to about 1 THz.

31. The slow wave circuit of claim 1, where helical conductive structure is sized for operation at one of approximately 95 GHz and approximately 170 GHz.

32. The slow wave circuit of claim 1, wherein said helical conductive structure is microfabricated.

33. The slow wave circuit of claim 32, wherein fabrication of said helical conductive structure is by one of a group comprising lithography, reactive ion etching, deep reactive ion etching and selective metallization.

34. The slow wave circuit of claim 32, wherein the fabrication of said helical conductive structure is on a wafer scale compatible with mass production.

35. The slow wave circuit of claim 1, wherein said helical conductive structure is monofilar.

36. A slow wave circuit of an electron device having a cathode and a collector, the slow wave circuit comprising: a helical conductive structure between the cathode and the collector, wherein an electron beam flows around the outside of the helical conductive structure and is shaped into an array of beamlets arranged in a circular pattern surrounding the helical conductive structure; a generally hollow barrel containing the helical conductive structure, wherein the barrel is square in shape; and a pair of continuous dielectric support structures bonded to the helical conductive structure and the hollow barrel.

37. The slow wave circuit of claim 36, wherein the electron device comprises a traveling wave tube (TWT).

38. The slow wave circuit of claim 37, wherein a spent beam emerging from the TWT is captured in a multistage depressed collector.

39. The slow wave circuit of claim 36, wherein the electron device comprises a backward wave oscillator (BWO).

40. The slow wave circuit of claim 39, wherein a spent beam emerging from the BWO is captured at low energy in a two stage collector that traps the electrons between crossed magnetic and electrical fields.

41. The slow wave circuit of claim 36, wherein the continuous dielectric support structures are comprised of diamond.

42. The slow wave circuit of claim 36, wherein the hollow barrel is comprised of diamond.

43. The slow wave circuit of claim 36, wherein the circuit operates at a frequency greater than 60 GHz.

44. A slow wave circuit of a helical traveling wave tube wherein output power from the tube is launched directly into free space from a helical antenna that is an extension of a helix of the slow wave circuit.

45. The slow wave circuit of claim 44, wherein the output power is greater than about 270 mW.

46. The slow wave circuit of claim 44, wherein the output power thereof is greater than about 70 mW.

47. The combination of helical slow wave circuit and a helical antenna in which a helix of the slow wave circuit is directly connected to a helix of the antenna.

48. The combination of claim 47 wherein said helical antenna is fabricated as an integral part of said helical slow wave circuit.

* * * * *